United States Patent [19]

O'Keefe

[11] 4,385,733

[45] May 31, 1983

[54] SPARE TOILET TISSUE HOLDER

[76] Inventor: Charles B. O'Keefe, 2579 N. Miller Rd., Scottsdale, Ariz. 85257

[21] Appl. No.: 262,300

[22] Filed: May 11, 1981

[51] Int. Cl.[3] ..... B65H 19/04

[52] U.S. Cl. ..... 242/55.3; 211/106; 211/181

[58] Field of Search ..... 242/55.2, 55.3, 55.53, 242/55.54; 206/233, 391; 211/16, 45, 47, 106, 119, 181

[56] References Cited

U.S. PATENT DOCUMENTS

| | | | |
|---|---|---|---|
| 2,790,608 | 4/1957 | Sieven | 242/55.3 |
| 2,872,124 | 2/1959 | Sieven | 242/55.3 |
| 3,086,724 | 4/1963 | Powell | 242/55.53 |
| 3,837,595 | 9/1974 | Boone | 242/55.3 |
| 4,106,616 | 8/1978 | Boone | 206/233 |

*Primary Examiner*—Leonard D. Christian
*Attorney, Agent, or Firm*—Harry M. Weiss

[57] ABSTRACT

A holder for a spare roll of toilet tissue includes a pair of vertical trunk members which hang from an existing toilet tissue dispenser. A rectangular frame portion is coupled to the lower portions of the trunk members and extends substantially perpendicularly therefrom. A support member is coupled to opposite sides of the frame and extends across the frame below the plane of said frame. The support member in conjunction with the rear portion of the frame support the spare roll. In a second embodiment, additional structural members are provided to form a storage compartment below the support member.

9 Claims, 2 Drawing Figures

SPARE TOILET TISSUE HOLDER

BACKGROUND OF THE INVENTION

1. Field of the Invention

This invention relates generally to a spare toilet tissue roll holder and, more particularly, to a spare toilet tissue roll holder which may be easily coupled to conventional commercial toilet paper dispensers and which may optionally include a utility shelf.

2. Description of the Prior Art

U.S. Pat. No. 3,086,724 describes an auxiliary toilet tissue holder which may be coupled to existing toilet tissue roll holders and which is adapted to contain a partial roll of toilet tissue. It was designed to reduced the waste of tissue by maids who are instructed to replace the roll with a full roll when it contains less than one-quarter of its full supply of tissue.

U.S. Pat. Nos. 3,837,595 and 4,106,616 describe supplemental sheet-dispensing devices which may be coupled to conventional toilet tissue dispensers and which contain wetted or otherwise treated sheet material.

None of the above arrangements have gained wide consumer acceptance. They are all lacking in both function and appearance. Further, none are suitable for holding a spare full roll of toilet tissue which is in full view so as to eliminate potential anxiety resulting from anticipation that an insufficient amount of toilet tissue remains.

SUMMARY OF THE INVENTION

It is the object of the present invention to provide a holder for an auxiliary or spare roll of toilet tissue which may be easily attached to conventional toilet tissue dispensers.

It is a further object of the invention to provide a spare toilet tissue roll holder which may be easily coupled to existing toilet tissue dispensers without alterations or modifications to the primary tissue roll holder and which, after coupling, remains in an orderly fixed position to give consistant performance.

It is a still further object of the present invention to provide a spare toilet tissue roll holder which is neat, simple and conforms to todays standards of appearance and which will maintain the spare roll in full view of the user. Thus, this eliminates the need for a partial tissue roll holder since the replacement roll will be used as soon as the primary roll is exhausted. Further, since the spare roll is in full view, the absence of a spare roll is easily detected.

Yet another object of the invention is to provide a spare toilet tissue roll holder which may be easily coupled to a standard toilet tissue dispenser and which is equipped with an auxiliary compartment for holding additional material or items; e.g. a container of premoistened toilet tissue sheets, a deodorizing device, an ash tray, etc.

According to a first aspect of the invention, there is provided a spare toilet tissue roll holder for mounting on an existing toilet tissue dispenser comprising first and second substantially vertical trunk members each having an upper portion for engaging said dispenser on opposite sides thereof and being supported thereby; a substantially rectangular frame portion coupled to lower portions of said first and second trunk members and extending substantially perpendicularly therefrom; and a support member attached to opposite sides of said frame portion and extending below the plane of said frame portion for supporting a spare roll of toilet tissue.

The above and other objects, features and advantages of the present invention will be better understood from the following detailed description taken in conjunction with the accompanying drawings, in which:

BRIEF DESCRIPTION OF THE DRAWING

FIG. 1 illustrates the inventive apparatus for holding a spare roll of toilet tissue 10. The apparatus hangs from an existing toilet tissue dispenser 12 which rotatably houses the primary roll of toilet tissue 14.

Figure 1:
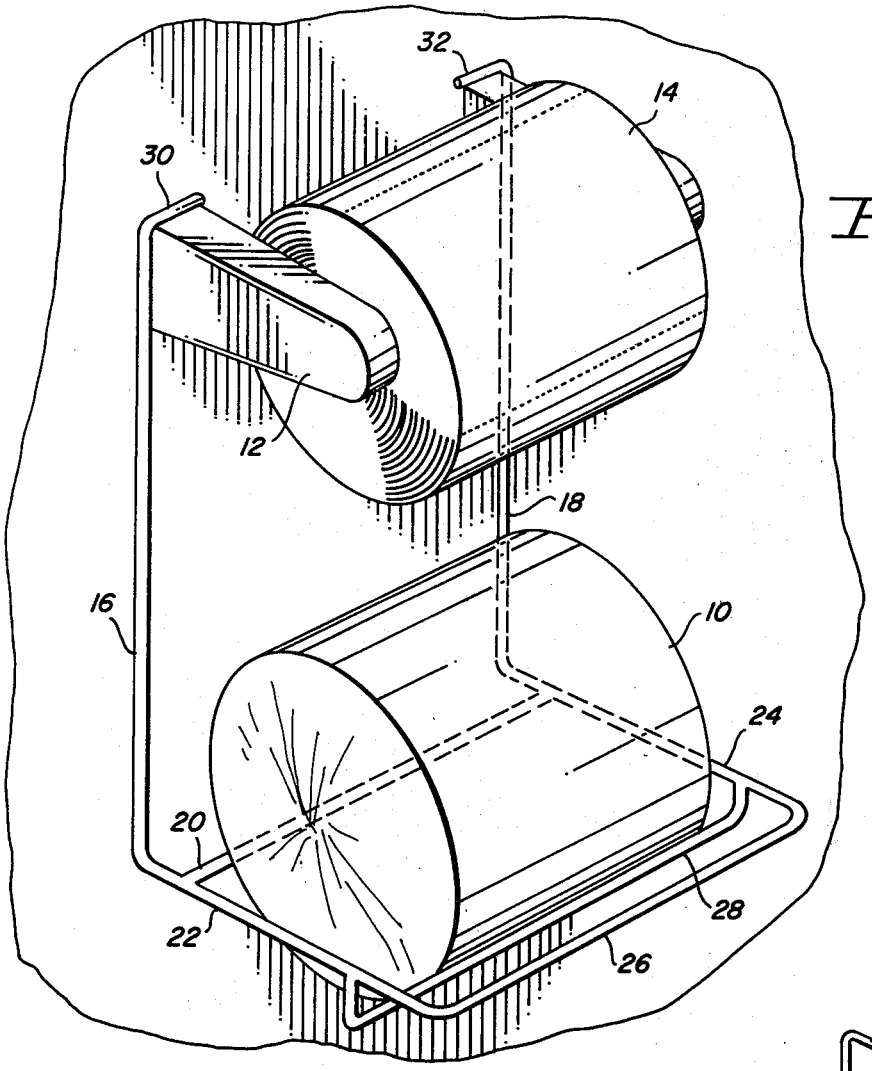
FIG. 1 is a perspective view of a spare toilet tissue roll holder according to the present invention.

The apparatus consists of first and second substantially vertical support trunks or members 16 and 18, respectively. A first horizontal support member or limb is attached to a first end of support member 16 and 18. First and second horizontal support retainer members 22 and 24 are also coupled to the first end of support members 16 and 18, respectively and extend substantially perpendicularly therefrom. A second horizontal support member 26 joins member 22 and 24 at their ends which are remote from members 16 and 18. A functional horizontal support bar 28 is coupled to horizontal support members 22 and 24. It is substantially parallel to members 20 and 26 but resides below the plane formed by members 20, 22 24 and 26. A pair of lateral rests or supports 30 and 32 are coupled to upper ends of vertical members 16 and 18, respectively and extend substantially perpendicularly therefrom. Lateral members 30 and 32 are mounted on the existing toilet tissue dispenser 12, and in this manner support the remainder of the apparatus and, thus, the spare roll.

Each trunk member 16 and 18 may be approximately ten inches in length. They should be made of a material that permits a certain amount of bending or lateral deformation (e.g. approximately one-quarter inch) so as to permit placement over the existing toilet tissue dispenser. The material should exhibit sufficient resiliency to permit the trunk members to retract to their original shape in a rest position such that the apparatus is supported by lateral rest members 30 and 32. The material may be clear plastic, acrylic, lucite, etc. so as to blend in with any decor and still exhibit the required resiliency.

Lateral members 30 and 32 may each be, for example, $\frac{5}{8}$ inches in length and extend toward each other and away from the trunk member to which it is attached leaving a gap of, for example, approximately five and on-half inches. An adhesive material such as two-sided tape may be fixed to the underside of members 30 and 32 to help secure the apparatus to the existing toilet tissue roll dispenser.

Horizontal members 20 and 26 may be approximately seven inches in length, and horizontal member 22 and 24 may be approximately four and one-half inches in length. Support bar 28 is fixed to horizontal members 22 and 24 at a point which is closer to member 26 than it is to member 20; e.g. approximately one and one-half inches from member 26. In this manner, the spare roll is directed to the rear of the apparatus. Further, the spare roll rests below members 22, 24 and 26 which prevents the spare roll from falling off the holder in a front or sideways direction.

Figure 2:
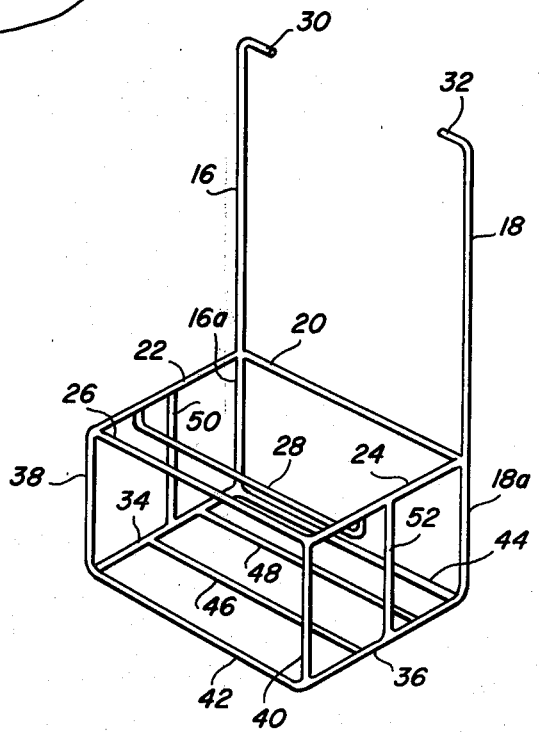
FIG. 2 is a perspective view of a spare toilet tissue roll holder including an auxiliary compartment in accordance with the teachings of the present invention.

FIG. 2 illustrates the spare toilet tissue roll holder shown in FIG. 1 further including a lower compartment for housing a deodorizing device, box of wetted tissues, etc. The compartment frame is formed by trunk member extensions 16*a* and 18*a*, additional horizontal members 34 and 36 attached to extensions 16*a* and 18*a*, respectively and extending perpendicularly therefrom additional vertical member 38 and 40 and additional horizontal 42 and 44 coupled between members 34 and 36. Thus, members 16*a*, 18*a*, 20, 22, 24, 26, 34, 36, 38, 40, 42 and 44 form a box like compartment. Additional horizontal support members 46 and 48 are coupled to members 34 and 36 between members 42 and 44. Vertical members 50 and 52 provide additional support and stability.

The above description is given by way of example only. Changes in form and details may be made by one skilled in the art without departing from the scope of the invention as defined by the appended claims. For example, all or some of the members may be formed integrally with each other or may be attached to each other, e.g. as by gluing.

What is claimed is:

1. A spare toilet tissue roll holder for mounting on an existing toilet tissue dispenser, comprising:

first and second substantially vertical trunk members each having an upper portion for engaging said dispenser on opposite sides thereof and being supported thereby;

a substantially rectangular frame portion coupled to lower portions of said first and second trunk members and extending substantially perpendicularly therefrom; and a support member coupled to opposite sides of said frame portion for supporting a spare roll of toilet tissue.

2. A holder according to claim 1 wherein said first and second trunk members have attached thereto first and second rest members, respectively, which extend generally towards each other and rest on said dispenser.

3. A holder according to claim 2 wherein said first and second trunk members possess sufficient resiliency so as to be expanded and placed over said dispenser and return to their original shape.

4. A holder according to claim 3 wherein said frame portion comprises:

a first horizontal member extending between lower portions of said first and second trunk members;

second and third horizontal members attached at first ends thereof to opposite ends of said first horizontal member and extending perpendicularly thereto; and a fourth horizontal member attached to second ends of said second and third horizontal members.

5. A holder according to claim 4 wherein said first and fourth horizontal members are substantially parallel and said second and third horizontal members are substantially parallel.

6. A holder according to claim 5 wherein said support member is coupled between and below said second and third horizontal members at points thereon which are more proximate said fourth horizontal member than said first horizontal member such that said spare roll is supported between said first horizontal member and said support member.

7. A holder according to claim 6 further comprising:

a plurality of substantially vertical members attached to and extending downward from said second and third horizontal members;

fifth and sixth horizontal members coupled respectively to bottom portions of each of said plurality of vertical members which are coupled to said second and third horizontal members respectively; and seventh and eighth horizontal members coupled between said fifth and sixth horizontal members at the extremities thereof to form a compartment the lower wall of which is below said support member.

8. A holder according to claim 7 further including at least one additional horizontal support member attached to said fifth and sixth horizontal members between said seventh and eighth horizontal members.

9. A holder according to claim 8 wherein all of said members are made of clear plastic.

* * * * *